US009716331B2

(12) United States Patent
Sasaki et al.

(10) Patent No.: US 9,716,331 B2
(45) Date of Patent: Jul. 25, 2017

(54) FEMALE CONTACT AND POWER CONNECTOR

(71) Applicant: JAPAN AVIATION ELECTRONICS INDUSTRY, LIMITED, Tokyo (JP)

(72) Inventors: Takuo Sasaki, Tokyo (JP); Takeshi Takahashi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/114,565

(22) PCT Filed: Jan. 7, 2015

(86) PCT No.: PCT/JP2015/050248
§ 371 (c)(1),
(2) Date: Jul. 27, 2016

(87) PCT Pub. No.: WO2015/159558
PCT Pub. Date: Oct. 22, 2015

(65) Prior Publication Data

US 2016/0352034 A1 Dec. 1, 2016

(30) Foreign Application Priority Data

Apr. 18, 2014 (JP) ..... 2014-086051

(51) Int. Cl.
*H01R 4/48* (2006.01)
*H01R 13/11* (2006.01)
*H01R 13/14* (2006.01)

(52) U.S. Cl.
CPC ..... *H01R 13/113* (2013.01); *H01R 13/14* (2013.01)

(58) Field of Classification Search
CPC ..... H01R 13/111; H01R 13/113; H01R 9/091; H01R 13/11; H01R 13/112; H01R 13/18
(Continued)

(56) References Cited

U.S. PATENT DOCUMENTS 4,385,794 A * 5/1983 Lucius ..... H01R 4/2466 439/399
5,007,865 A * 4/1991 Jakobeit ..... H01R 13/18 439/839
(Continued)

FOREIGN PATENT DOCUMENTS

JP H07-296886 A 11/1995
JP H10-223284 A 8/1998
(Continued)

*Primary Examiner* — Thanh Tam Le
(74) *Attorney, Agent, or Firm* — Greenblum & Bernstein, P.L.C.

(57) ABSTRACT

A female contact made of a bent sheet includes a socket part which receives a male contact, a terminal part to which an electrical wire is connected, and an intermediate part which interconnects the socket part and the terminal part. The intermediate part includes a U-shaped part having a U-shaped cross-section and an extended part extended outside the U-shape of the U-shaped part through a 90°-bent part from an edge in a width direction at one end of the U-shape. An end of the extended part is coupled to the socket part, and the other end of the U-shape is coupled to the terminal part. Both of the U-shaped part and the extended part have widths smaller than the width of a spring piece which is in the socket part and configured to contact the male contact.

10 Claims, 9 Drawing Sheets

(58) Field of Classification Search
USPC ..... 439/851–857, 839
See application file for complete search history.

(56) References Cited

U.S. PATENT DOCUMENTS 5,611,717 A 3/1997 Joly
5,624,273 A * 4/1997 Myer ..... H01R 4/2466 439/399
5,658,175 A * 8/1997 Muzslay ..... H01R 13/111 29/874
5,879,181 A * 3/1999 Okabe ..... H01R 4/2466 439/397
5,911,603 A * 6/1999 Mansutti ..... H01R 13/111 439/748
5,924,887 A * 7/1999 Aoyama ..... H01R 4/2466 439/400
6,019,626 A * 2/2000 Abe ..... H01R 4/184 439/399
6,247,975 B1 * 6/2001 Cue ..... H01R 13/187 439/845
6,261,134 B1 * 7/2001 Muzslay ..... H01R 43/16 29/857
6,394,858 B1 * 5/2002 Geltsch ..... H01R 13/114 439/843
7,347,747 B2 * 3/2008 Shimizu ..... H01R 13/11 439/842
7,927,127 B1 * 4/2011 Glick ..... H01R 4/245 439/397

FOREIGN PATENT DOCUMENTS

JP 2001-110247 A 4/2001
JP 2006-172732 A 6/2006
JP 2010-061962 A 3/2010
JP 2011-054480 A 3/2011

* cited by examiner

FEMALE CONTACT AND POWER CONNECTOR

TECHNICAL FIELD

The present invention relates to a power connector and, in particular, to a structure of a female contact provided in a power connector.

BACKGROUND ART

FIG. 1A illustrates a terminal structure of a secondary battery and a structure of a bus bar which interconnects adjacent secondary batteries that are described in Patent Literature 1. The secondary battery 10 includes a main body 11 which houses a set of electrodes, positive and negative electrode terminals and a plate 12. FIG. 1A illustrates a cross-sectional structure of the positive electrode terminal 13. The positive electrode terminal 13 includes a connector part 14 and a positive electrode plate 15.

The connector part 14 includes a connector main body 14*a*, an opening 14*b* formed in the upper part of the connector main body 14*a*, and a projection 14*c* provided on a side surface of the opening 14*b*. The positive electrode plate 15 protrudes in the opening 14*b* of the connector main body 14*a* thorough an opening 12*a* provided in the plate 12. The negative electrode terminal has a structure similar to the positive electrode terminal 13 illustrated in FIG. 1A.

A mating connector part 22 is provided at each of the ends of the bus bar 20 which are spaced a given distance apart from each other with a main body 21 between them. The bus bar 20 includes the main body 21, the mating connector parts 22, openings 23 each provided at the lower end of a corresponding one of the mating connector parts 22, a conductor 24, wherein each of the mating connector parts 22 includes a bent part 25 which is a bent portion of the conductor 24 in the opening 23, a raised part 26 which is provided on an inner surface of the opening 23 and faces the bent part 25, and a recess 27 provided in a position corresponding to the projection 14*c* of the connector part 14.

FIG. 1B illustrates the secondary battery 10 and the bus bar 20 connected with each other. The mating connector parts 22 at the ends of the bus bar 20 are respectively inserted in the openings 14*b* of the connector parts 14 of the positive electrode terminal and the negative electrode terminal of adjacent secondary batteries. Like FIG. 1A, FIG. 1B illustrates the positive electrode terminal 13 side.

An end of the positive electrode plate 15 of the positive electrode terminal 13 contacts the bent part 25 and the raised part 26 of the mating connector part 22, and the projection 14*c* fits into the recess 27 of the mating connector part 22 to complete the connection.

PRIOR ART LITERATURE

Patent Literature

Patent literature 1: Japanese Patent Application Laid Open No. 2010-61962

SUMMARY OF THE INVENTION

Problems to be Solved by the Invention

For interconnecting electrical connectors in general, one of the connectors includes a male contact, the other includes a female contact that receives the male contact, the male contact and the female contact are mated and brought into contact with one another to provide electrical connection. A spring contact (spring piece) for producing contact pressure is usually provided in the female contact. In the structure that interconnects the bus bar 20 and the secondary battery 10 described above, the connector part 14 of the secondary battery 10 includes a male contact and the mating connector part 22 of the bus bar 20 includes a female contact and a spring contact is formed by the bent part 25 in the female contact.

On the other hand, there is the problem that if vibration or other impact is applied while such a male contact and the spring contact of a female contact are in contact with each other, the portion of the male contact and the portion of the female contact that are in contact with one another move relative to each other, causing a contact failure. This occurs because plating of the contact portions peels off due to friction between the contact portions of moving male and female contacts. The contact portions where plating has peeled off can corrode to increase contact resistance, leading to a contact failure. Such a problem can occur in the structure illustrated in FIGS. 1A and 1B that interconnects connector part 14 of the secondary battery 10 and the mating connector part 22 of the bus bar 20.

An object of the present invention is to provide a female contact that is configured to make contact with a male contact to conduct electricity and is capable of inhibiting a force that would move a portion in contact with the male contact from being transmitted to the contact portion if such force is exerted due to vibration or other impact, thereby inhibiting movement of the contact portion to enhance contact reliability, and to provide a power connector comprising the female contact.

Means to Solve the Problems

According to the present invention, a female contact made of a bent sheet includes a socket part which receives a mating male contact, a terminal part to which an electrical wire is connected, and an intermediate part which interconnects the socket part and the terminal part. The intermediate part includes a U-shaped part having a U-shaped cross-section and an extended part extended outside the U-shape of the U-shaped part through a 90°-bent part from an edge in a width direction at one end of the U-shape. An end of the extended part is coupled to the socket part, and the other end of the U-shape is coupled to the terminal part. Both of the U-shaped part and the extended part have widths smaller than the width of a spring piece which is provided in the socket part and is configured to contact the male contact.

Effects of the Invention

The intermediate part of the female contact according to the present invention is capable of absorbing a force exerted by vibration or other impact to inhibit the force from being transmitted to the portion that is in contact with a male contact. Accordingly, movement of the contact portion can be inhibited to solve the problem of a contact failure due to friction between the contact portions. Thus the female contact that has high contact reliability can be provided.

DETAILED DESCRIPTION OF THE EMBODIMENTS

Figure 1A:
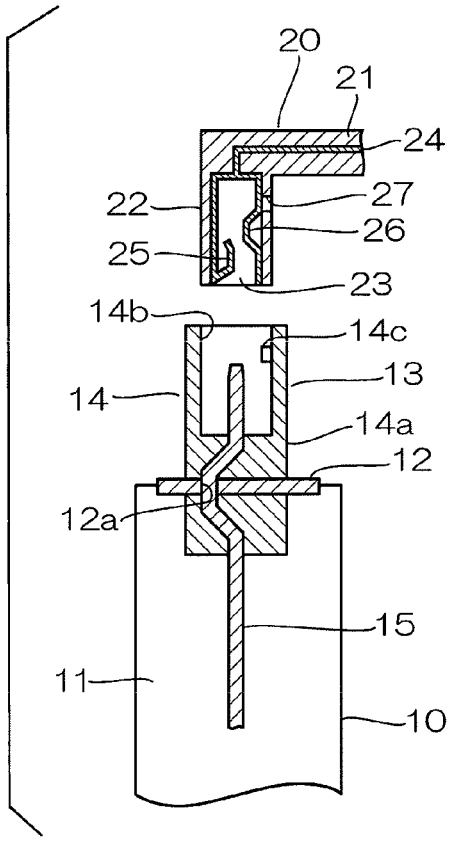
Fig. 1A PRIOR ART
FIG. 1A is a cross-sectional view illustrating a secondary battery and a structure of a connector part of a bus bar as an example of a conventional power connector.
Figure 1B:
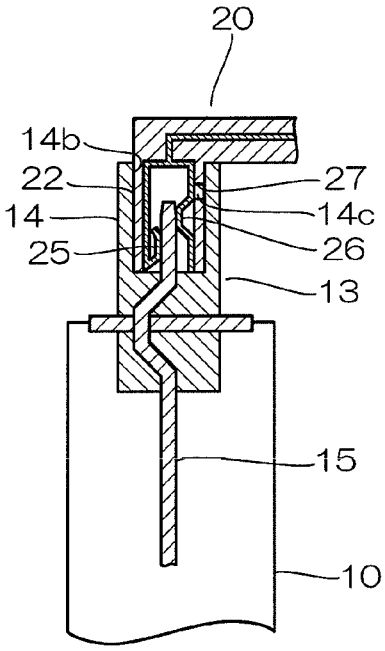
Fig. 1B PRIOR ART
FIG. 1B is a cross-sectional view illustrating how the connector part in FIG. 1A is connected.

Embodiments of the present invention will be described below.

FIG. 2A, 2B and FIGS. 3 to 5 illustrate a form of one embodiment of a female contact according to the present invention. The female contact 100 is designed to be installed in a power connector. The female contact 100 is formed of a sheet worked by bending. The sheet is made of a highly-conductive pure copper material and is thick so as to carry a large current. The surface of the sheet is plated with silver.

The female contact 100 includes a socket part 30 which receives a mating male contact, a terminal part 40 to which an electrical wire is connected, and an intermediate part 50 which interconnects the socket part 30 and the terminal part 40.

The socket part 30 includes a shell 31 which has a square tube, a pair of front bent pieces 33 which covers one end (front end) of the shell 31 with a slit-like opening 32 being left between them, two spring pieces 34, and two auxiliary spring pieces 35.

Each of the two spring pieces 34 is bent back toward the inside of the shell 31 which is formed by bending the sheet into square tubes, from a rear end side of a facing portion 31*a* of the shell 31 where edges of the sheet of the shell 31 faces to each other. Each of the spring pieces 34 is made up of a bent base 34*a* and an extended part 34*b* extended from the base 34*a* toward the front bent piece 33. An end portion of the extended part 34*b* is bent into a dog leg and is bifurcated to form a contact portion 34*c*. Notches 31*c* are provided in a side surface 31*b* of the shell 31 that continues to each base 34*a*; the notches extend from the edges of the facing part 31*a*. Each of the two spring pieces 34 is elongated in response to the presence of the notches 31*c*, that is, has a form with a flexible portion being added.

Each of the two auxiliary spring pieces 35 is bent back toward the inside of the shell 31 from the front end side of the side surfaces 31*b* of the shell 31, and is extended toward the rear end side of the shell 31. A bent part 35*a* is formed at end of each auxiliary spring piece 35. The front bent pieces 33 described above are positioned anterior to the auxiliary spring pieces 35. The width of each auxiliary spring piece 35 is equal to the width of the extended part 34*b* of each spring piece 34. The two auxiliary spring pieces 35 are positioned in positions corresponding to the two spring pieces 34 and are provided so that the bent parts 35*a* at the ends thereof are in contact with back sides of the extended parts 34*b* of the spring pieces 34 (surfaces opposite to the surfaces in which the contact portions 34*c* protrude). The provision of the auxiliary spring pieces 35 enhances the contact pressure of the spring pieces 34.

A linear dowel 36 protruding inside of the shell 31 is formed on a side surface 31*d* of the shell 31 that faces the surface of the front surface (the surface the side of which the contact portion 34*c* protrudes) of each spring piece 34. A dowel 37 protruding outside of the shell 31 is formed at the front end of the side surface 31*d*.

The shape of the intermediate part 50 will be described next.

The intermediate part 50 includes a U-shaped part 51 having a U-shaped cross-section and an extended part 53 extended outside the U-shape of the U-shaped part 51 from an edge in the width direction at one end of the U-shape with a 90°-bent part 52 being between the U-shaped part 51 and the extended part 53. The U-shaped part 51 in this example is made up of a first flat surface 51*a* and a second flat surface 51*b* which are parallel to one another, and a third flat surface 51*e* which is coupled to the first flat surface 51*a* and the second flat surface 51*b* via 90°-bent parts 51*c* and 51*d*. One end of the U-shaped part 51 at which the 90°-bent part 52 is provided is narrower than the other end and the width of the U-shaped part 51 is changed in roughly the center of the third flat surface 51*e* in this example.

In the intermediate part 50 which has the shape as described above, one end of the extended part 53 is coplanar with one side surface 31*d* of the shell 31 of the socket part 30 and is coupled to the rear end of the side surface 31*d* and the wider other end of the U-shaped part 51 is coupled to the terminal part 40. The other end of the U-shaped part 51 in this example is coupled to the terminal part 40 through a 90°-bent part 54.

The terminal part 40 which has a L-shaped cross-section is made up of a first sheet part 41 that forms one leg of the shape of letter L and a second sheet part 42 that forms the other leg of the L. The first sheet part 41 is parallel to the third flat surface 51*e* of the U-shaped part 51 and the second sheet part 42 is parallel to the side surfaces 31*b* and 31*d* of the shell 31. The U-shaped part 51 is coupled to the first sheet part 41 via the 90°-bent part 54.

Here, three orthogonal axes are denoted by X, Y and Z. A mating male contact is inserted into the socket part 30 through an opening 32 at the front end of the socket part 30 and the sheet surface of the extended part 53 is in the X-Y plane, where the X direction is the direction in which the male contact is inserted and the Z direction is the direction of the width of the spring pieces 34. The first and second flat surfaces 51*a*, 51*b* of the U-shaped part 51 are in the Y-Z plane and the third flat surface 51*e* is in the X-Y plane. In other words, the intermediate part 50 in this example has three orthogonal flat surfaces and the three orthogonal flat surfaces are coupled together via the 90°-bent parts.

Figure 5:
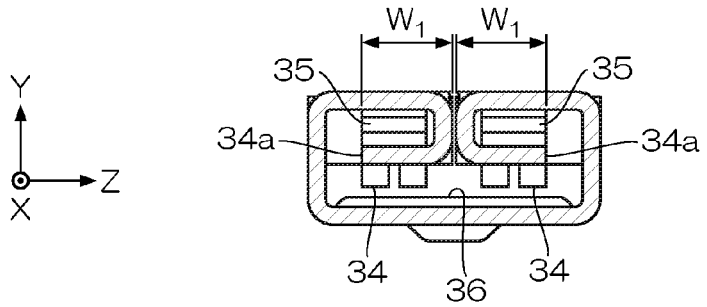
FIG. 5 is an enlarged cross-sectional view taken along line 5-5 in FIG. 2B.

Since the two spring pieces 34 that are to contact the male contact are provided in this example and each of the spring pieces 34 is made up of the base 34*a* and the extended part 34*b* which are bent from the shell 31 as described above, the two spring pieces 34 which function as springs to apply contact pressure to the male contact have an effective width of $2\times W_1$, where $W_1$ is the width of the base 34*a* in the Z direction, as illustrated in FIG. 5.

Figure 2A:
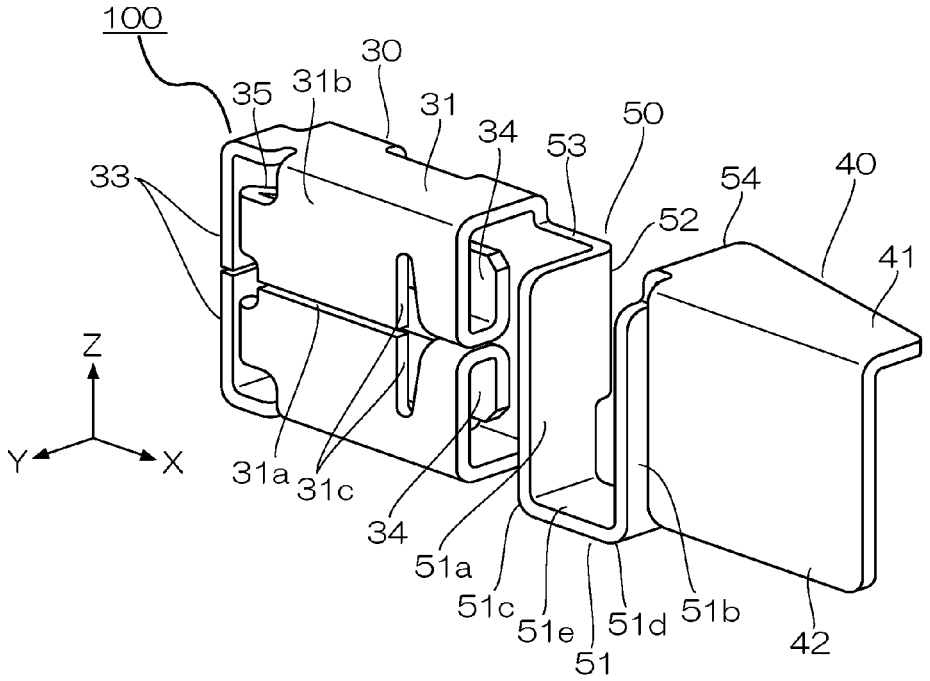
FIG. 2A is a perspective view illustrating one embodiment of a female contact according to the present invention.
Figure 2B:
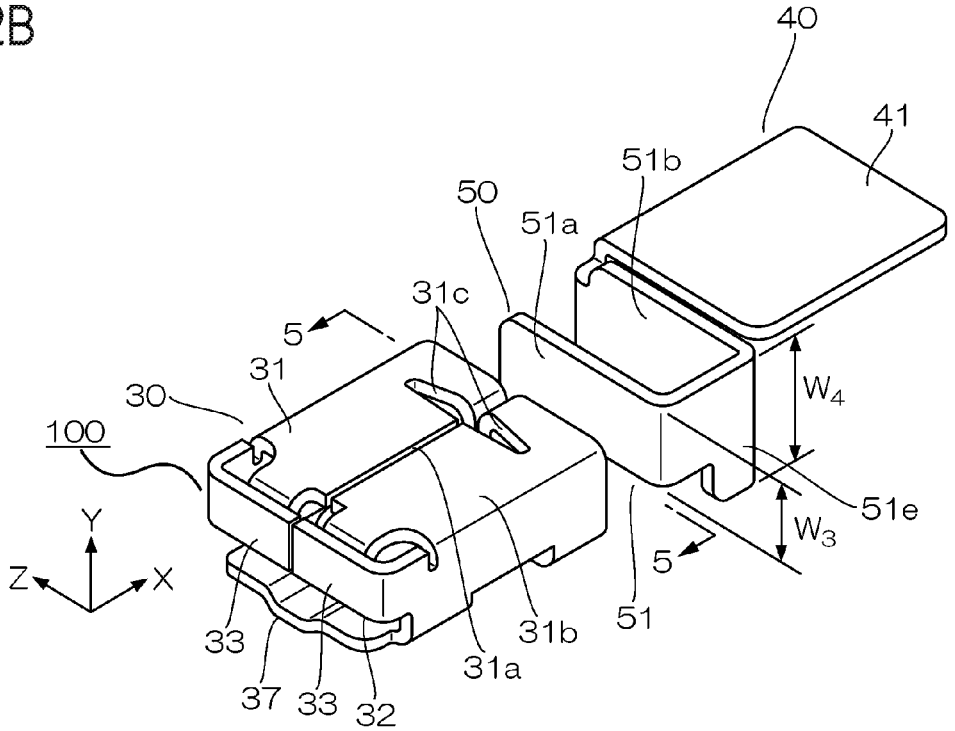
FIG. 2B is a perspective view of the female contact illustrated in FIG. 2A, viewed from another direction.
Figure 3:
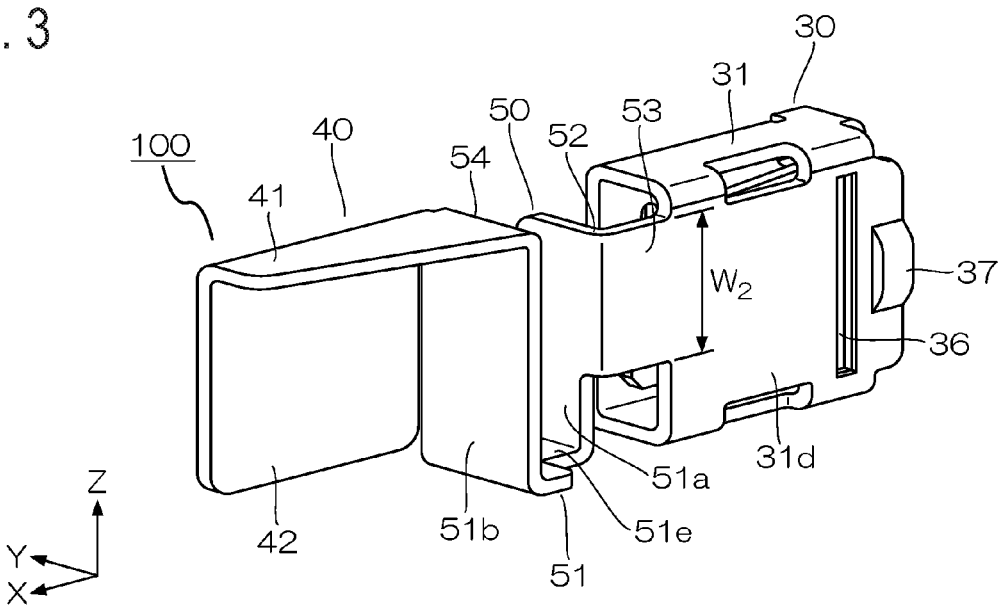
FIG. 3 is a perspective view of the female contact illustrated in FIG. 2A, viewed from yet another direction.
Figure 4:
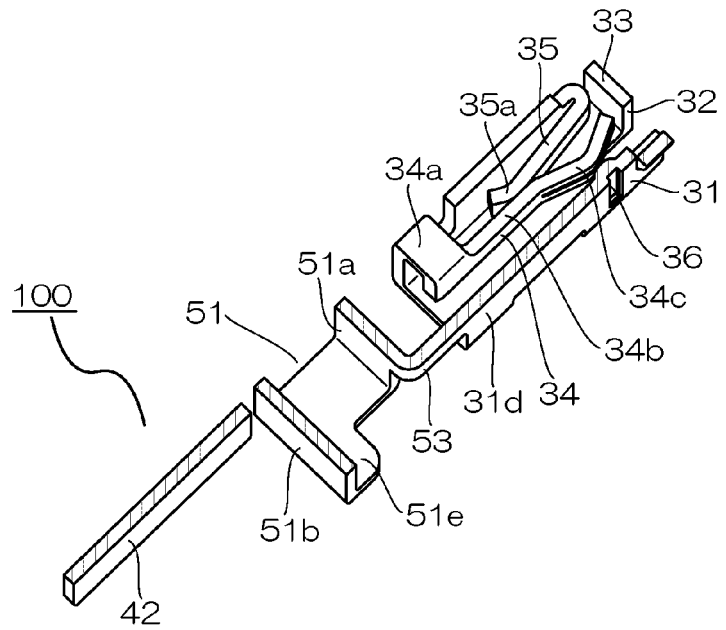
FIG. 4 is a perspective cross-sectional view of the female contact illustrated in FIG. 2A.

On the other hand, the widths of the extended part 53 and the U-shaped part 51 in the direction orthogonal to the direction in which the extended part 53 and the U-shaped part 51 extend are as follows. Let the width of the extended part 53 in the Z direction be denoted by $W_2$ as illustrated in FIG. 3, and the widths of the narrow portion and wide portion of the U-shaped part 51 denoted by $W_3$ and $W_4$ as illustrated in FIG. 2B, then each of $W_2$, $W_3$ and $W_4$ is smaller than $2\times W_1$.

Because the intermediate part 50 is configured as described above, the intermediate part 50 has a spring force and is capable of flexing when a force is applied in any of the directions along the X, Y and Z axes. Since the width $W_2$ of the extended part 53 which flexes in response to a force applied in the Y direction and the widths $W_3$ and $W_4$ of the U-shaped part 51 which flex in response to forces applied in the X direction and the Z direction are smaller than the width of the spring pieces 34 of the socket part 30, $2\times W_1$, the intermediate part 50 is capable of absorbing a force that would otherwise move the contact portions 34*c* of the spring pieces 34 is applied in any of the directions along three orthogonal axes. Accordingly, even though vibration or other impact is applied, movement of the contact portions 34*c* can be inhibited and problems such as a contact failure caused by contact resistance increased due to friction with the male contact can be avoided.

Figure 6:
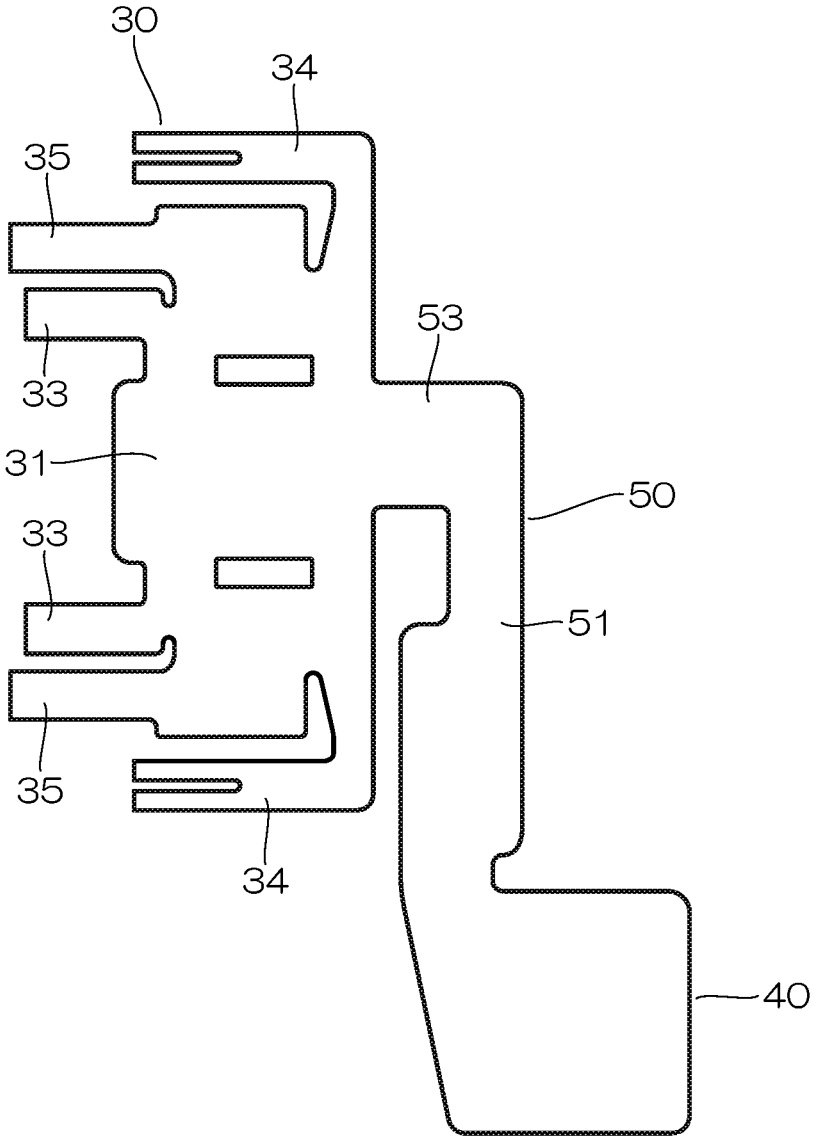
FIG. 6 is a developed view of the female contact illustrated in FIG. 2A.

FIG. 6 illustrates a developed view of the female contact 100. Parts that form the main parts described above are given the same reference numerals as those of the main parts. The dowels 36 and 37 are omitted from FIG. 6.

Figure 7:
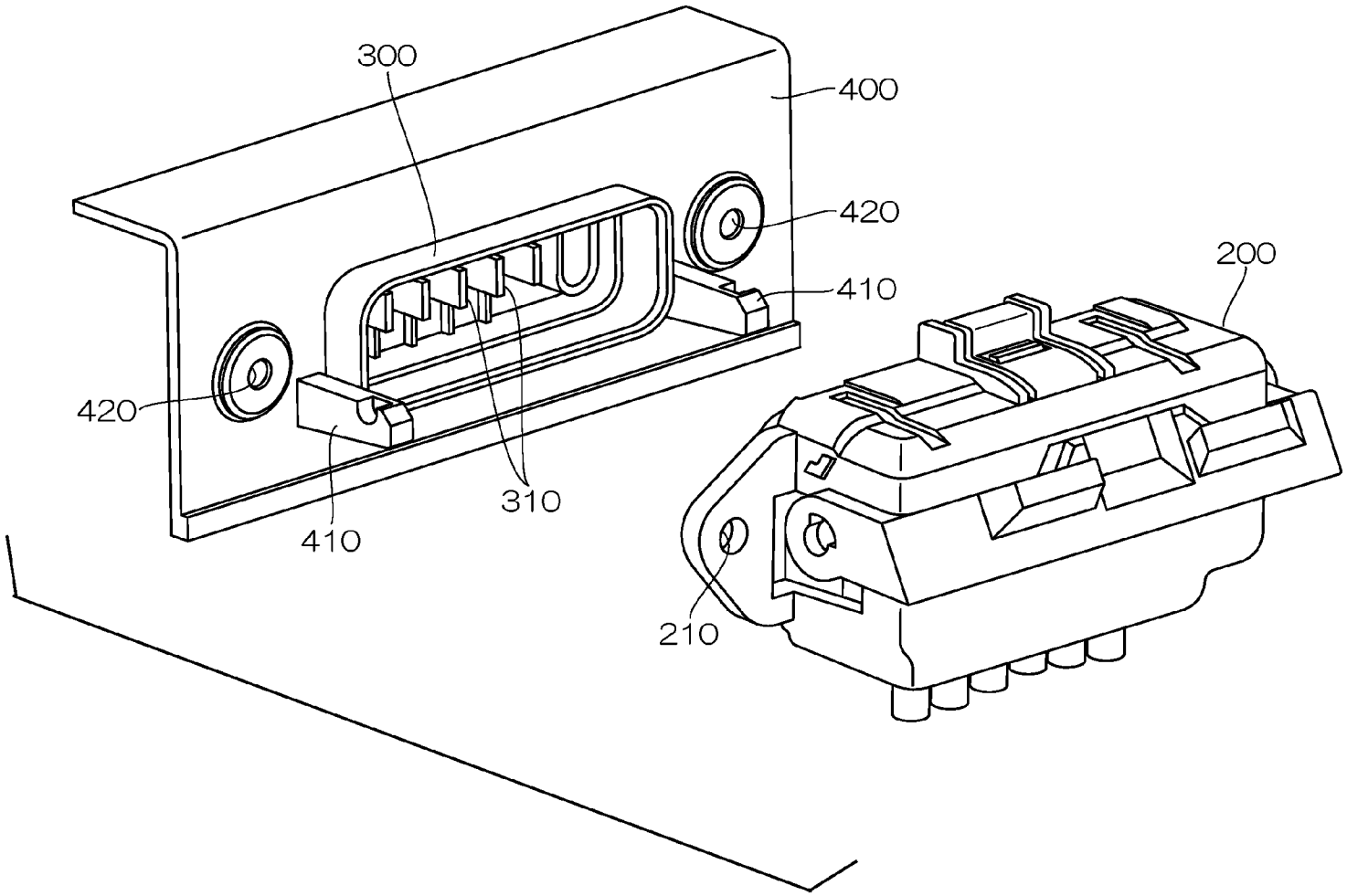
FIG. 7 is a perspective view of a harness-side power connector including the female contact illustrated in FIG. 2A and a mating power connector provided in a housing.

FIG. 7 illustrates a power connector 200 which includes the female contact 100 inside it and a mating power connector 300 to which the power connector 200 is to be connected. The power connector 200 is attached to a harness, not depicted in detail, and the mating power connector 300 is attached to a housing 400. The power connectors 200 and 300 are intended to be installed in a vehicle.

In FIG. 7, reference numeral 310 denotes the male contacts of the power connector 300. A pair of hooks 410 and a pair of screw holes 420 are provided in the housing 400. The hooks 410 and the screw holes 420 are used for holding the power connector 200 and for receiving bolts, respectively, when the power connector 200 is connected to the power connector 300. Through holes 210 corresponding to the pair of screw holes 420 in the housing 400 are provided in the power connector 200.

Figure 8:
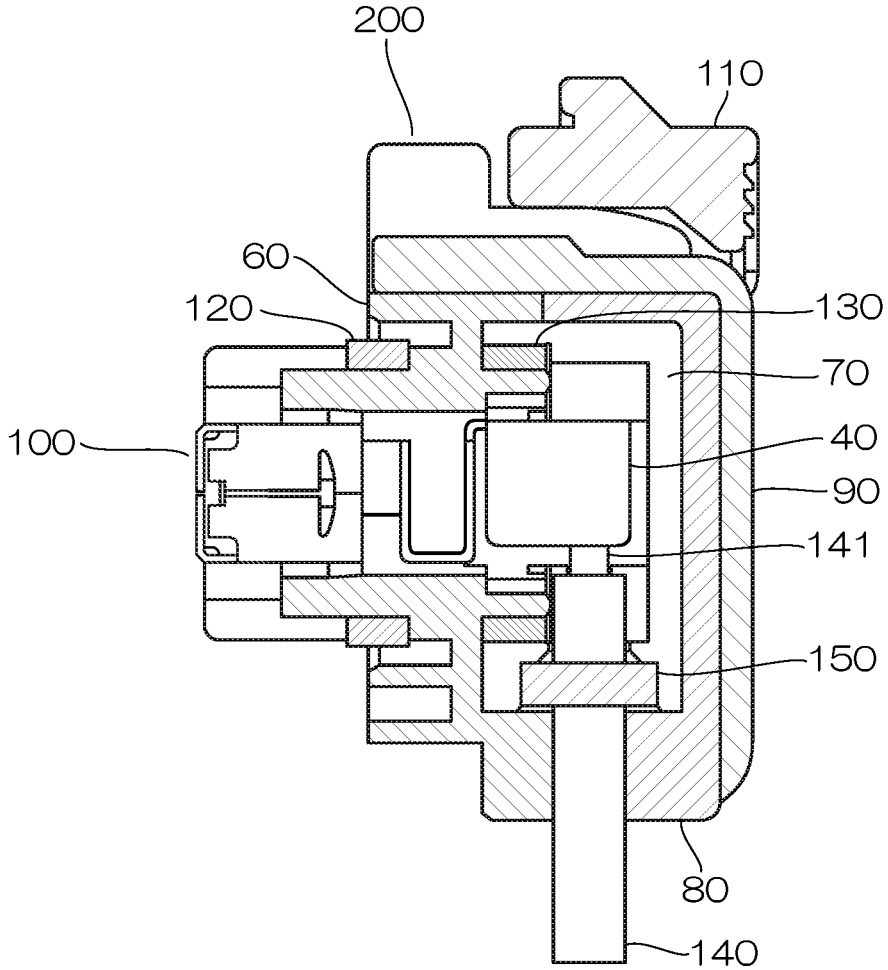
FIG. 8 is an enlarged cross-sectional view of the harness-side power connector illustrated in FIG. 7.

FIG. 8 illustrates an internal structure of the power connector 200. As illustrated in FIG. 8, the female contacts 100 are housed in and fixed to the power connector 200. In FIG. 8, reference numeral 60 denotes the housing and reference numeral 70 denotes a sub-housing. Reference numeral 80 denotes a cable holder and reference numeral 90 denotes a cover. Reference numeral 110 denotes a lever and reference numerals 120 and 130 denote sealing rubbers. Reference numeral 140 denotes a cable and reference numeral 150 denotes a cable fixing member.

Each cable 140 is wedged between and firmly fixed by the housing 60 and the cable holder 80. A cable core 141 extracted by removing insulating coating at an end of each cable 140 is connected to the terminal part 40 of the female contact 100. The connection between the terminal part 40 and the cable core 141 is accomplished by ultrasonic welding, for example.

Figure 9:
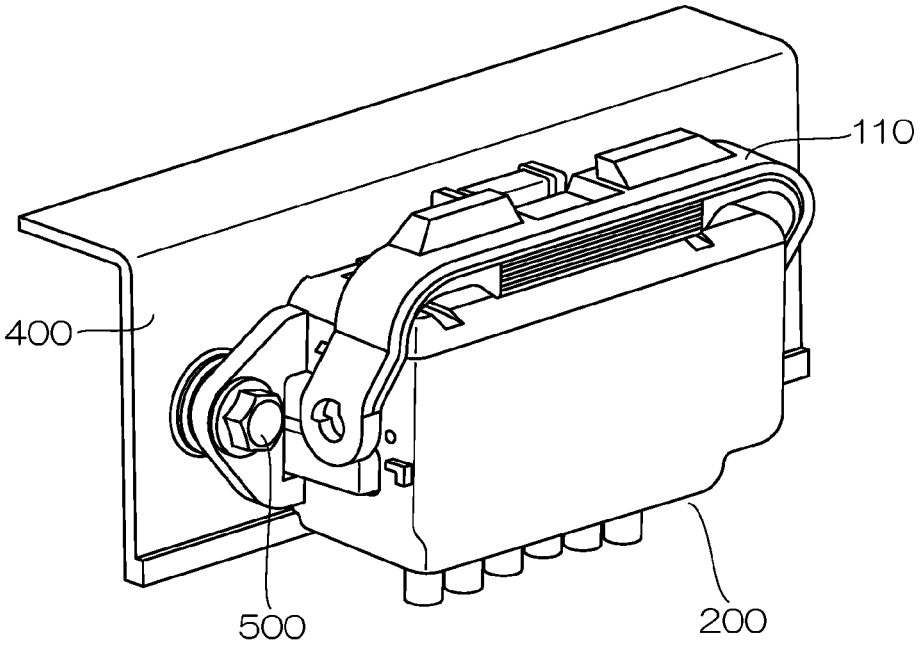
FIG. 9 is a perspective view illustrating the power connectors illustrated in FIG. 7 connected with each other.

FIG. 9 illustrates the power connectors 200 and 300 connected with one another. In FIG. 9, reference numeral 500 denotes bolts for fixing the power connector 200 to the housing 400. Note that the lever 110 has been turned upward from the position illustrated in FIG. 7.

Figure 10A:
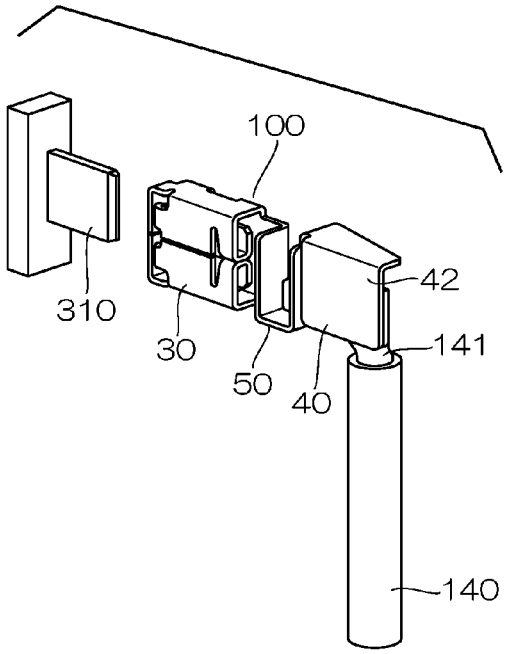
FIG. 10A is a perspective view illustrating the female contact of the harness-side power connector and a male contact of the housing-side power connector before mating.
Figure 10B:
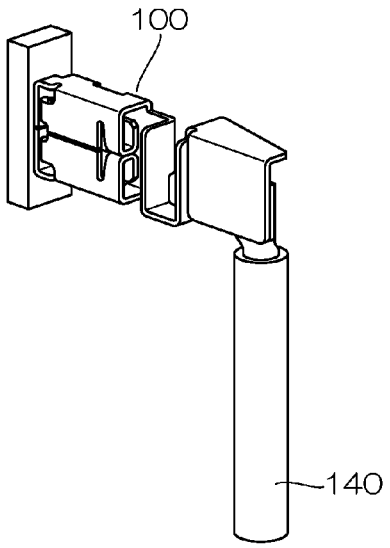
FIG. 10B is a perspective view illustrating the male contact and the female contact illustrated in FIG. 10A mated with each other.
Figure 11A:
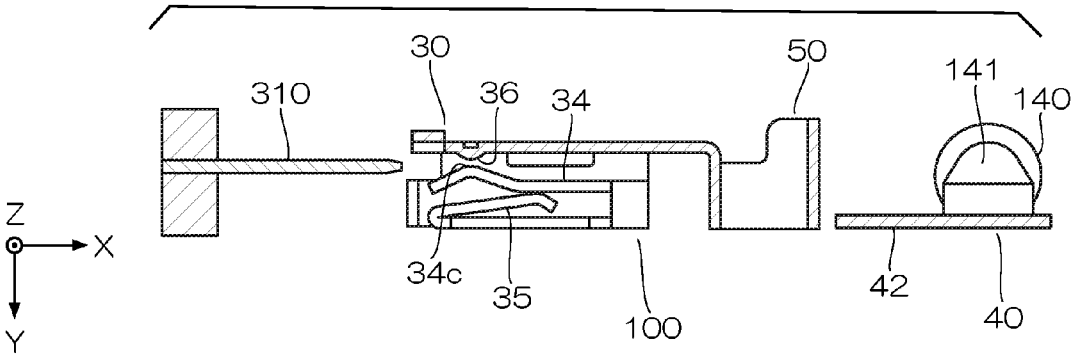
FIG. 11A is an enlarged cross-sectional view of the female contact and the male contact illustrated in FIG. 10A before mating.
Figure 11B:
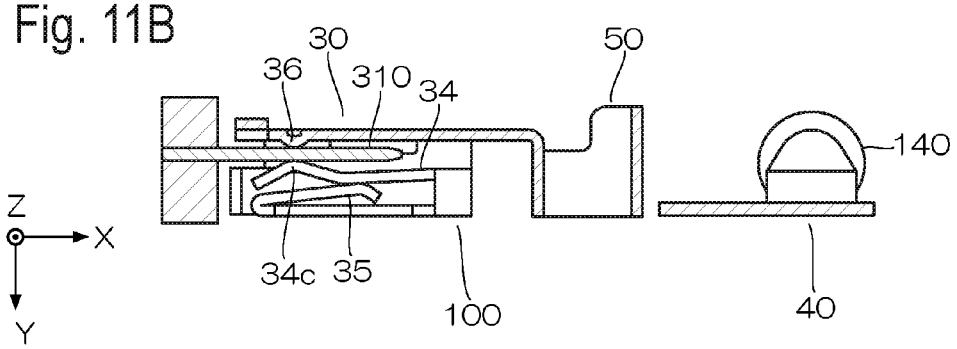
FIG. 11B is an enlarged cross-sectional view of the female contact and the male contact illustrated in FIG. 10B mated with each other.

FIGS. 10A, 10B, 11A and 11B illustrate how the female contact 100 of the power connector 200 is mated with the male contact 310 of the mating power connector 300. FIGS. 10A and 11A illustrate the power connectors 200 and 300 before mating and FIGS. 10B and 11B illustrate the power connectors 200 and 300 mated with one another. The male contact 310 is made of a sheet and takes the form of a flat panel. The sheet is a pure copper sheet, for example, and the surface thereof is plated with silver.

The gap between the contact portion 34*c* and the dowel 36 of the female contact 100 are smaller than the thickness of the male contact 310. When the male contact 310 is inserted into the gap, the spring pieces 34 is displaced, the displacement of the spring pieces 34 displaces the auxiliary spring pieces 35 to bring the male contact 310 and the female contact 100 into contact and continuity with one another with required contact pressure.

In the mating state illustrated in FIGS. 10B and 11B, the base end of the male contact 310 is the fixed end and the terminal part 40 side of the female contact 100 is the fixed end. In other words, in the state illustrated in FIGS. 10B and 11B, both ends are fixed and the section between the fixed ends can be considered to be a system that has a degree of freedom. Accordingly, when vibration is applied, a force is exerted on the system. However, since the intermediate part 50 of the female contact 100 in this example absorbs the force exerted on the system as described above, the force is inhibited from being transmitted to the contact portions 34*c*, i.e. the contact portions between the male contact 310 and the female contact 100, resulting in reduction of movement of the contact portions.

Figure 12:
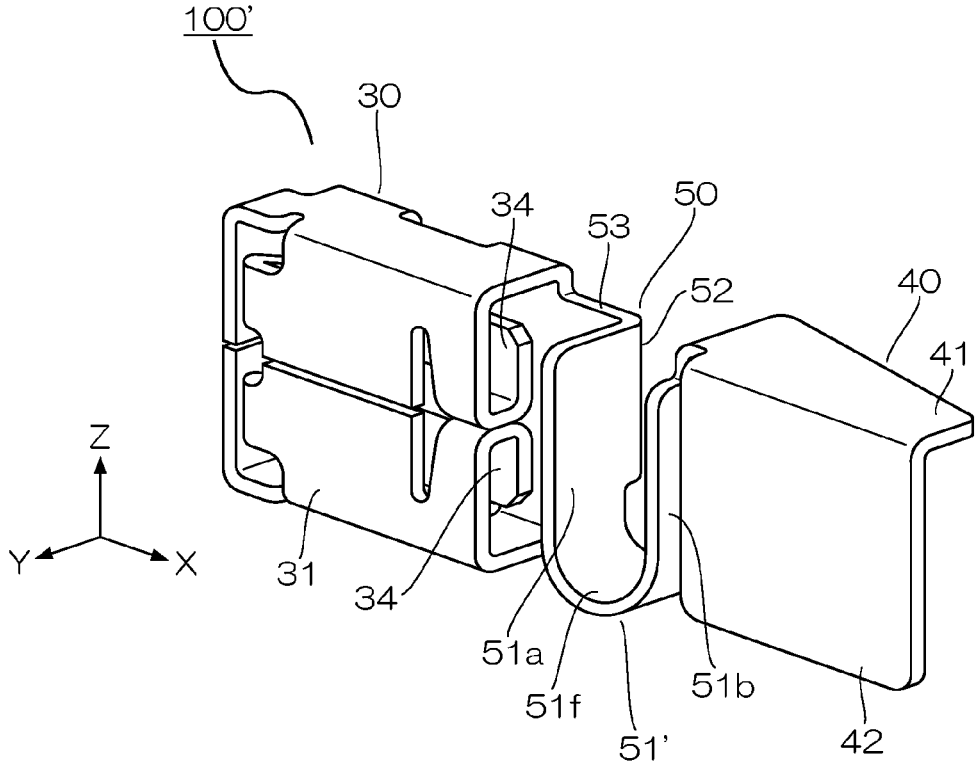
FIG. 12 is a perspective view illustrating another embodiment of a female contact according to the present invention.

FIG. 12 illustrates a form of another embodiment of a female contact according to the present invention. In this example, a U-shaped part of the intermediate part has a shape different from the shape of the U-shaped part of the intermediate part of the female contact 100 illustrated in FIG. 2A.

The U-shaped part 51' of the female contact 100' illustrated in FIG. 12 is made up of a first flat surface 51*a* and a second flat surface 51*b* which are parallel to one another, and a semi-cylindrical surface 51*f* which interconnects the first flat surface 51*a* and the second flat surface 51*b*. The U-shaped part 51 illustrated in FIG. 2A may be replaced with the U-shaped part 51' having this shape. Again, the intermediate part 50 is capable of absorbing a force applied in any of the directions along the three orthogonal axes.

Note that the intermediate part 50 is capable of absorbing not only a force exerted due to vibration but also forces caused by changes in ambient temperature and other conditions and therefore is capable of ensuring contact stability and reliability over a long period of time.

Since the female contacts 100, 100' described above are intended to be used in a power connector and need to have as large a cross-sectional area as possible in order to carry high current, the spring force for the intermediate part 50 to absorb a force needs to be limited to the minimum necessary. Widths $W_2$, $W_3$ and $W_4$ are chosen by taking into consideration this requirement as well.

What is claimed is:

1. A female contact having a socket for receiving a male contact, the socket having one or more contact springs configured to contact the male contact, the female contact comprising a terminal; and an intermediate part, wherein:

the intermediate part comprises a U-shaped part having two ends which are spaced from each other through an air gap;

an extended part; and a 90°-bent part, one end of the 90°-bent part is directly connected to a side edge of the U-shaped part near one of the two ends of the U-shaped part, one end of the extended part is directly connected to the socket, an other end of the extended part is directly connected to an other end of the 90°-bent part, an other of the two ends of the U-shaped part is directly connected to the terminal, a direction in which the two ends of the U-shaped part are spaced from each other is parallel to an insertion direction in which the male contact is inserted into the socket, each of the U-shaped part and the extended part has a width smaller than a sum of each width of the one or more contact springs, the width measured along a direction orthogonal to the insertion direction, and the female contact has a shape bent out of a single flat sheet.

2. The female contact according to claim 1, wherein the U-shaped part is made up of first, second and third flat plates and two bent parts, the first and second flat plates being parallel to one another and the third flat plate being connected to the first and second plates through the two bent parts, and the one end of the 90°-bent part is directly connected to a side edge of either one of the first and second flat plates.

3. The female contact according to claim 1, wherein the U-shaped part is made up of first and second flat plates and a semi-cylindrical part, the first and second flat plates being parallel to one another and the semi-cylindrical part interconnecting the first and second flat plates, and the one end of the 90°-bent part is directly connected to a side edge of either one of the first and second flat plates.

4. The female contact according to claim 2, wherein a sheet surface of the extended part is parallel to an X-Z plane and each of the first and second flat plates is parallel to a Y-Z plane, where X, Y and Z are three-dimensional orthogonal coordinate axes, an X direction is parallel to the insertion direction, and a Z direction is parallel to a width direction of the one or more contact springs.

5. A power connector comprising the female contact according to claim 1.

6. The female contact according to claim 3, wherein a sheet surface of the extended part is parallel to an X-Z plane and each of the first and second flat plates is parallel to a Y-Z plane, where X, Y and Z are three-dimensional orthogonal coordinate axes, an X direction is parallel to the insertion direction, and a Z direction is parallel to a width direction of the one or more contact springs.

7. A power connector comprising the female contact according to claim 2.

8. A power connector comprising the female contact according to claim 3.

9. A power connector comprising the female contact according to claim 4.

10. A power connector comprising the female contact according to claim 6.

* * * * *